US005993098A

United States Patent [19]

Osada

[11] Patent Number: 5,993,098

[45] Date of Patent: Nov. 30, 1999

[54] AQUEOUS GEL INK-FILLED BALL POINT PEN

[75] Inventor: Takahiro Osada, Sawa-gun, Japan

[73] Assignee: Mitsubishi Pencil Kabushiki Kaisha, Tokyo, Japan

[21] Appl. No.: 08/990,160

[22] Filed: Dec. 12, 1997

[30] Foreign Application Priority Data

Dec. 12, 1996 [JP] Japan ..... 8-332491

[51] Int. Cl.[6] ..... B43K 7/01

[52] U.S. Cl. ..... 401/209; 401/216

[58] Field of Search ..... 401/209, 216

[56] References Cited

U.S. PATENT DOCUMENTS

| | | | |
|---|---|---|---|
| 3,533,708 | 10/1970 | Horie | 401/209 |
| 4,349,639 | 9/1982 | Muller | 401/21 X |
| 4,384,800 | 5/1983 | Dyama | 401/209 X |
| 4,653,950 | 3/1987 | Yoshida | 401/209 X |
| 4,973,180 | 11/1990 | Hori | 401/209 X |
| 5,150,979 | 9/1992 | Gallagher | 401/209 |
| 5,609,432 | 3/1997 | Yamamoto et al. | 401/209 |

*Primary Examiner*—David J. Walczak
*Assistant Examiner*—Kathleen J. Prunner
*Attorney, Agent, or Firm*—Darby & Darby

[57] ABSTRACT

Provided is an aqueous gel ink-filled ball point pen having less blobbing and capable of drawing stable lines having vivid color and no uneven written intensity. The aqueous gel ink-filled ball point pen has a ball of a diameter of 0.3 to 2.0 mm at a tip point with an aqueous gel ink having a viscosity ratio (a value of (viscosity at 10 rpm)/(viscosity at 50 rpm) measured by means of an E type rotational viscometer) of 1.1 to 4.0 and controlled an ink lay down value according to JIS Standard S6053 to 50 to 200 mg/m.

8 Claims, 1 Drawing Sheet

AQUEOUS GEL INK-FILLED BALL POINT PEN

BACKGROUND OF THE INVENTION

1. Field of the Invention

The present invention relates to an aqueous gel ink-filled ball point pen, more specifically to a ball point pen filled with an ink having properties expressed by pseudo-plasticity, non-Newtonian viscosity or shear thinning viscosity.

2. Description of the Prior Art

A ball point pen is composed of a pen tip comprising a ball and a tip holder, an ink reservoir and a barrel. In writing with a ball point pen, the ink flowing out of the inside of the tip with rotation of the ball is transferred on or penetrated into a recording material such as paper, whereby letters and lines are written.

An aqueous ink-filled ball point pen has the advantage that it uses an ink having a low viscosity of several mPa•s and therefore can write at a low writing pressure and has a good writing feeling. However, it has the defect that natural outflow of the ink from the point of the tip, a so-called point seepage (hereinafter called a direct flow phenomenon) or a back-leaking phenomenon in which air flows in from the tip of the ball point pen to allow the ink to flow out from the ink reservoir is liable to take place. A method in which an ink absorber such as a bundle of fiber is used is employed to prevent these phenomena.

Further, there is the problem that if the ball point pen is left in a cap-off condition, the solvent is dried up because of the high vapor pressure of the solvent, and therefore the pen point is dried to prevent the ink from flowing out, so that the ball point pen becomes incapable of writing.

On the other hand, a conventionally known oil base ball point pen uses an ink having a high viscosity of several thousand mPa•s and therefore has the defect that the ball receives large resistance in rotating when the ink flow out of the pen tip to deteriorate a writing feeling. Further, there are the problems that the less amount of the ink flows out of the tip in writing to cause a blobbing phenomenon and bring about unevenness on drawn lines and that the line intensity is weak and therefore a high writing pressure is required.

In order to improve the oil base ball point pen, a ball point pen for an aqueous ink having a so-called medium viscosity which falls within a middle viscosity region (several mPa•s to several thousand mPa•s) ranging between the viscosities of an aqueous ink and an oil base ink has recently been developed. This is a ball point pen using a relatively low viscosity aqueous ink having the characteristic that the viscosity of the ink is lowered by the rotation of the ball point to allow the ink to flow out smoothly, a so-called shear thinning viscosity.

This ink is called a gel ink, and the property thereof is shown by expression such as pseudo-plasticity, non-Newtonian viscosity and the like in a certain case.

However, if this ink has too strong property as gel, the flowability of the ink is inferior, and the outflow of the ink from the pen point is deteriorated in writing, so that starving and inferior writing are caused. Too much outflow brings about feathering and blobbing phenomena in some cases. On the other hand, if gelation is weak and the viscosity is low, the phenomenon that the ink is liable to bring about back flow or direct flow is observed. Accordingly, writing feeling, back flow and direct flow phenomena and pen structure exert influence on each other, so that an ideal aqueous gel ink-filled ball point pen has not yet been obtained.

SUMMARY OF THE INVENTION

An object of the present invention is to solve the problems described above and provide an aqueous gel ink-filled ball point pen having less blobbing and capable of drawing stable lines having vivid color and no uneven intensity of written lines.

Intensive researches made by the present inventors in order to achieve the objects described above have resulted in finding that the problems can be solved by adjusting the relation of the structure of a tip with the strength of gel and controlling the lay down value of ink and thus coming to complete the aqueous gel ink-filled ball point pen of the present invention.

The aqueous gel ink-filled ball point pen of the present invention is an ordinary ball point pen having a refill comprising a pen tip comprising a ball and a tip holder, an ink reservoir and a coupling for connecting the tip with the reservoir. The lay down value of the ink according to JIS standard S6053 is controlled to 50 to 200 mg/100 m by selecting an ink having a suitable viscosity ratio depending on the diameter of the point of the tip or selecting a suitable tip depending on the viscosity ratio of the gel ink.

That is, the aqueous gel ink-filled ball point pen of the present invention is different from ones obtained by merely charging conventional ball point pens with a gel ink as is the case with conventional ones.

DETAILED DESCRIPTION OF THE PREFERRED EMBODIMENT

Figure 1:
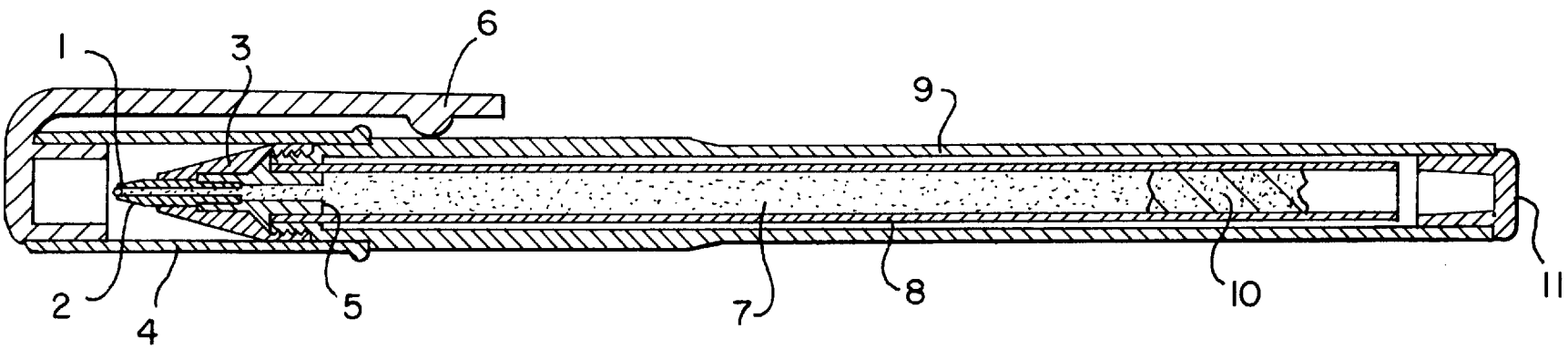
FIG. 1 depicts a ballpoint pen of the invention charged with an aqueous gel ink.

FIG. 1 depicts a ballpoint pen of the type well known in the art, containing a ball 1 and tip 2 housed in a mouthpiece 3. An aqueous gel ink 7 and ink follower 10 are housed in an ink reservoir 8 contained in barrel 9. A cap 4 having a clip 6 is placed over the mouthpiece containing the ball and tip. A joint 5 connects the ink reservoir with the tip. An end plug 11 seals the ink reservoir.

The aqueous gel ink-filled ball point pen of the present invention is obtained by charging a ball point pen having a ball point of a diameter of 0.3 to 2.0 mm with an aqueous gel ink and controlling an ink lay down value according to JIS Standard S6053 to 50 to 200 mg/100 m, and the aqueous gel ink described above has a viscosity ratio of 1.1 to 4.0, wherein the viscosity ratio represents a value of (viscosity at 10 rpm)/(viscosity at 50 rpm) measured by means of an E type rotational viscometer.

The ink lay down value of 50 to 200 mg/100 m shows a characteristic representing the intensity of written lines, wherein the ink lay down value is obtained from a difference between the following two weight values; the weight of the ball point pen measured after writing a line of 400 m on a writing paper by means of a writing tester and the weight of the ball point pen measured after writing further a line of 100 m.

The ink lay down value of 50 mg or less is too low, and brings about starving due to a reduction in the intensity and inferior ball rotation. On the other hand, the ink lay down value of 200 mg or more is too high, and therefore brings about feathering and blobbing phenomena and delays drying of the drawn lines to cause the stain on hands and clothes.

The tip of the aqueous gel ink-filled ball point pen of the present invention has a ball having a diameter of 0.3 to 2.0 mm. The structure and the material of the tip shall not specifically be restricted and are those used for conventional ball point pens. A sintered hard alloy is usually used for a ball material, and ceramics, resins and rubber are included as well. Stainless steel, bronze and German silver are usually used for a holder material, and resin-molded articles can be used as well.

Inks containing colorants, pseudo-plasticizers and aqueous medium components are used as the gel ink for the ball point pen of the present invention.

The aqueous medium component represents water and polar solvents other than water and includes, for example, water or water soluble organic solvents. Specific examples thereof include alkylene glycols such as ethylene glycol, triethylene glycol, tetraethylene glycol, dipropylene glycol, 1,2-propanediol, 1,3-propanediol, 1,2-butanediol, 2,3-butanediol, 1,3-butanediol, 1,4-butanediol, 1,2-pentanediol, 1,5-pentanediol, 2,5-hexanediol, 3-methyl-1,3-butanediol and 2-methylpentane-2,4-diol, polyalkylene glycols such as polyethylene glycol and polypropylene glycol, triols such as 3-methypentane-1,3,5-triol and 1,2,3-hexanetriol, glycerols such as glycerol, diglycerol and triglycerol, lower alkyl ethers of glycols such as ethylene glycol monomethyl ether, ethylene glycol monoethyl ether, diethylene glycol monomethyl ether, diethylene glycol monoethyl ether and diethylene glycol mono-n-butyl ether, thiodiethanol, N-methyl-2-pyrrolidone and 1,3-dimethyl-2-imidazolidinone.

Usually, the content thereof is preferably 5.0 to 30% by weight based on the whole amount of the ink.

The pseudo-plasticizer includes natural resins such as xanthane gum, tamarind gum, carrageenan gum, tragacanth gum, locust bean gum, gum arabic, guar gum, curdlan, pectin, agar, gelatin and mannan which are composed of monosaccharides and polysaccharides such as glucose, mannose, galactose, rhamnose and glucuronates, celluloses such as methyl cellulose, ethyl cellulose and carboxymethyl cellulose, acrylic and urethane synthetic polymers, and inorganic natural or semi-synthetic products such as smectite and montmorillonite.

A pigment used for the colorant shall not specifically be restricted, and optional ones selected from inorganic and organic pigments which have so far conventionally been used for aqueous pigment ink compositions can be used.

The inorganic pigments include, for example, titanium oxide, carbon black and metal powder, and the organic pigments include, for example, azo lakes, insoluble azo pigments, chelate azo pigments, phthalocyanine pigments, perylene and perinone pigments, anthraquinone pigments, quinacridone pigments, dye lakes, nitrto pigments and nitroso pigments.

To be specific, there can be used phthalocyanine blue (C.I. 74160), phthalocyanine green (C.I. 74260), Hansa yellow 3G (C.I. 11670), disazo yellow GR (C.I. 21100), Permanent red 4R (C.I. 12335), Brilliant carmine 6B (C.I. 15850) and quinacridone red (C.I. 46500).

These pigments may be used alone or in combination of two or more kinds thereof. The content thereof is selected usually from a range of 5 to 10% by weight, preferably 6 to 8% by weight based on the weight of the whole ink. When the content of the pigment is less than 5% by weight, the intensity of the drawn lines becomes weak. On the other hand, when it exceeds 10% by weight, the ink becomes unstable as time goes on, and therefore it is not preferred.

Nonionic and anionic surfactants and water soluble polymers are used as a dispersant which is adsorbed on the surface of a pigment particle to disperse the pigment in water. The water soluble polymers are preferably used.

The nonionic surfactants include polyoxyalkylene higher fatty acid esters, higher fatty acid partial esters of polyhydric alcohols and higher fatty acid esters of saccharide. To be specific, they include glycerin fatty acid esters, polyglycerin fatty acid esters, propylene glycol fatty acid esters, pentaerythritol fatty acid esters, polyoxyethylene sorbitan fatty acid esters, polyoxyethylene sorbitol fatty acid esters, polyoxyethylene glycerin fatty acid esters, polyethylene glycol fatty acid esters, polyoxyethylene alkyl ethers, polyoxyethylene phytosterol, polyoxyethylene polyoxypropylene alkyl ethers, polyoxyethylene alkylphenyl ethers, polyoxyethylene castor oil, polyoxyethylene lanolin, polyoxyethylene lanolin alcohols, polyoxyethylene alkylamines, polyoxyethylene fatty amides and polyoxyethylene alkylphenyl formaldehyde condensation products.

The anionic surfactants include alkylated sulfonates of higher fatty acid amides and alkylallylsulfonates. To be specific, they include alkylsulfates, polyoxyethylene alkyl ether sulfates, N-acylamino acid salts, N-acylmethyltaurine salts, polyoxyethylene alkyl ether acetates, alkylphosphates and polyoxyethylene alkyl ether phosphates. The water soluble polymers include polyacrylic acids, acrylic acid copolymers and a maleic acid resin. To be specific, used are those obtained by turning resins such as an acrylic acid resin, a styrene acrylic resin and a styrene maleic acid resin into salt forms to make them water soluble. Sodium and potassium are typical as alkali metals for forming the salts, and typical as amines for forming the salts are aliphatic primary to tertiary amines such as mono-, di- or tri-methylamine, alcoholamines such as mono-, di- or tri-propanolamine, methylethanolamine, methylpropanolamine and dimethylethanolamine, ammonia, morpholine, and N-methylmorpholine.

The content of the dispersant is 0.5 to 5.0% by weight based on the weight of the ink and 10 to 50% by weight based on the weight of the pigment.

Any of direct dyes, acid dyes, food dyes and basic dyes as water soluble dyes can be used as a dye for the colorant.

Examples of the direct dyes shall be described below.

C.I. Direct Black 17, ditto 19, ditto 22, ditto 32, ditto 38, ditto 51 and ditto 71, C.I. Direct Yellow 4, ditto 26, ditto 44 and ditto 50, C.I. Direct Red 1, ditto 4, ditto 23, ditto 31, ditto 37, ditto 39, ditto 75, ditto 80, ditto 81, ditto 83, ditto 225, ditto 226 and ditto 227, and C.I. Direct Blue 1, ditto 15, ditto 71, ditto 86, ditto 106 and ditto 119.

Further, examples of the acid dyes shall be described below.

C.I. Acid Black 1, ditto 2, ditto 24, ditto 26, ditto 31, ditto 52, ditto 107, ditto 109, ditto 110, ditto 119 and ditto 154, C.I. Acid Yellow 7, ditto 17, ditto 19, ditto 23, ditto 25, ditto 29, ditto 38, ditto 42, ditto 49, ditto 61, ditto 72, ditto 78, ditto 110, ditto 127, ditto 135, ditto 141 and ditto 142, C.I. Acid Red 8, ditto 9, ditto 14, ditto 18, ditto 26, ditto 27, ditto 35, ditto 37, ditto 51, ditto 52, ditto 57, ditto 82, ditto 87, ditto 92, ditto 94, ditto 111, ditto 129, ditto 131, ditto 138, ditto 186, ditto 249, ditto 254, ditto 265 and ditto 276, C.I. Acid Violet 15 and ditto 17, C.I. Acid Blue 1, ditto 7, ditto 9, ditto 15, ditto 22. ditto 23, ditto 25, ditto 40, ditto 41, ditto 43, ditto 62, ditto 78, ditto 83, ditto 90, ditto 93, ditto 103, ditto 112, ditto 113 and ditto 158, and C.I. Acid Green 3, ditto 9, ditto 16, ditto 25 and ditto 27.

A great part of the food dyes is included in the direct dyes or the acid dyes, and one example of what are not included therein includes C.I. Food Yellow 3.

Next, examples of the basic dyes shall be described below.

C.I. Basic Yellow 1, ditto 2 and ditto 21, C.I. Basic Orange 2, ditto 14 and ditto 32, C.I. Basic Red 1, ditto 2, ditto 9 and ditto 14, C.I. Basic Violet 1, ditto 3 and ditto 7, C.I. Basic green 4, C.I. Basic Brown 12, and C.I. Basic Black 2 and ditto 8.

These colorants may each be used alone or in combination of two or more kinds thereof.

Further, lubricants, rust preventives, antiseptics and pH controllers can be used if necessary.

The ink used for the ball point pen of the present invention can be produced, for example, by the following three steps.

1. Preparation of pigment-dispersed material (toner)

A pigment, a dispersant, a solvent, additives and water are sufficiently dispersed by means of a dispersing machine such as a beads mill and a ball mill and then centrifuged to remove coarse matters, whereby a toner is obtained.

2. Preparation of pseudo-plasticizer base (gel base)

A pseudo-plasticizer is slowly added to a prescribed amount of water, and stirring is continued to completely dissolve it in water. Then, a base such as monoethanolamine and triethanolamine is added to control pH to 6 to 9, whereby a gel base is prepared.

3. Preparation of ink

The gel base and the solvent are weighed and then sufficiently mixed by means of a stirrer.

Then, the toner is added to further continue stirring until the gelled matter is homogeneously dissolved, and foreign matters are removed by a filter, whereby an aqueous gel ink is obtained.

EXAMPLES

The present invention shall be explained in further detail with reference to examples.

The physical properties of the aqueous gel inks used for the ball point pens in the examples and the comparative examples were determined by the following methods.

Viscosity:

Measured at a temperature of 25° C. by means of an E type viscometer.

Viscosity ratio:

Viscosities were measured at rotating speeds of 10 rpm and 50 rpm (25° C.) by means of the E type viscometer, and the viscosity ratio was obtained from the following equation:

$$\text{Viscosity ratio}=(\text{viscosity at rotating speed of 10 rpm})/(\text{viscosity at rotating speed of 50 rpm})$$

Ink lay down:

The weight ($W_1$) of the ball point pen was measured before writing, and then the weight ($W_2$) of the ball point pen was measured after writing a line of 100 m on a writing paper by means of a writing test machine (Minitech). The ink lay down was calculated from the following equation:

$$\text{Ink lay down}=W_1-W_2$$

The ball point pens prepared in the examples and the comparative examples were evaluated by the following methods.

Writing condition:

The ball point pens were used for writing by means of a writing test machine, and the flow conditions of the inks were evaluated according to the following criteria:

◎ Particularly good

○ Good

× Starved

Drawn line condition:

The ball point pens were used for writing by means of a writing test machine, and the drawn line conditions thereof were evaluated according to the following criteria:

◎ Particularly good

○ Good

× Pale

Blobbing prevention:

After writing under the conditions of a speed of 4.5 m/minute, an angle of 60° and a load of 100 g by means of a writing test machine, an ink amount adhered to the tip holder and surplus ink spots fallen during drawing the line were observed and evaluated according to the following criteria:

◎ Scarcely found

○ Slightly found

Δ A little much found

× Much found

Drawn line dryability:

"Spiral" is drawn on a writing paper in an air-conditioned room having a temperature of 25° C. and a humidity of 65%, and after 10 seconds, the spiral was rubbed with a commercial cotton swab to observe and evaluate stain caused by the ink according to the following criteria:

◎ No stain found and particularly good

○ Little stain found

× Stained

The aqueous gel inks used in the examples and the comparative examples were prepared in the following manner.

Ink A:

A gel ink A was prepared in the following composition.

| | |
|---|---|
| Carbon black | 8.0 parts by weight |
| Acrylic resin (molecular weight: 10,000) | 1.5 part by weight |
| Aminomethylpropanol | 1.0 part by weight |
| Alkylphosphates | 1.0 part by weight |
| Carboxymethyl cellulose | 0.4 part by weight |
| Propylene glycol | 20.0 parts by weight |
| Deionized water | 68.1 parts by weight |

The aqueous gel ink having a viscosity ratio of 1.24 was obtained.

Ink B:

A gel ink B was prepared in the following composition.

| | |
|---|---|
| Carbon black | 8.0 parts by weight |
| Acrylic resin (molecular weight: 5,000) | 1.5 parts by weight |
| Aminomethylpropanol | 0.7 part by weight |
| Alkylphosphates | 1.0 part by weight |
| Xantan gum | 0.4 part by weight |
| Glycerin | 5.0 parts by weight |
| Propylene glycol | 20.0 parts by weight |
| Deionized water | 63.4 parts by weight |

The water base gel ink having a viscosity ratio of 3.75 was obtained.

Example 1

The holder of a ball point pen ("Signo UM-100" manufactured by Mitsubishi Pencil Co., Ltd.) was used to charge a refill comprising a propylene-made ink reservoir having an inner diameter of 3.8 mm and a length of 113 mm and a stainless steel-made tip (ball made of a sintered hard alloy and having a diameter of 0.5 mm) with the ink A described above, and a follower used for "Signo UM-100" was filled into the ink rear end, whereby the aqueous gel ink-filled ball point pen of the present invention was prepared.

The ink lay down value was 126. The test results of the writing condition, the drawn line condition, the drawn line dryability and blobbing are shown in Table 1.

Example 2

An aqueous gel ink-filled ball point pen was prepared in the same manner as in Example 1, except that a tip comprising a ball made of a sintered hard alloy and having a diameter of 0.3 mm was used.

The test results are shown in Table 1.

Example 3

The holder of the ball point pen ("Signo UM-100" manufactured by Mitsubishi Pencil Co., Ltd.) was used to charge a refill comprising a propylene-made ink reservoir having an inner diameter of 3.8 mm and a length of 113 mm and a stainless steel-made tip (ball made of a sintered hard alloy and having a diameter of 2.0 mm) with the ink B described above, and a follower used for "Signo UM-100" was filled into the ink rear end, whereby the aqueous gel ink-filled ball point pen of the present invention was prepared.

The test results are shown in Table 1.

Comparative Example 1

An aqueous gel ink-filled ball point pen was prepared in the same manner as in Example 3, except that a tip comprising a ball made of a sintered hard alloy and having a diameter of 0.7 mm was used.

The test results are shown in Table 1.

Comparative Example 2

An aqueous gel ink-filled ball point pen was prepared in the same manner as in Example 1, except that a tip comprising a ball made of a sintered hard alloy and having a diameter of 2.0 mm was used.

The test results are shown in Table 1.

TABLE 1

| | Example | | | Comparative Example | |
|---|---|---|---|---|---|
| | 1 | 2 | 3 | 1 | 2 |
| Ink kind | A | A | B | B | A |
| Ink viscosity ratio | 1.24 | 1.24 | 3.75 | 3.75 | 1.24 |
| Diameter (mm) of ball in tip | 0.7 | 0.3 | 2.0 | 0.7 | 2.0 |
| Ink lay down value (mg/100 m) | 126 | 54 | 196 | 47 | 245 |
| Writing condition | ◎ | ○ | ◎ | X | ◎ |
| Drawn line condition | ◎ | ○ | ○ | X | X |

TABLE 1-continued

| | Example | | | Comparative Example | |
|---|---|---|---|---|---|
| | 1 | 2 | 3 | 1 | 2 |
| Blobbing prevention | ○ | ◎ | ○ | ◎ | X |
| Drawn line dryability | ○ | ◎ | ○ | ◎ | X |

What is claimed is:

1. An aqueous gel ink-filled ball point pen in which the ball point pen having a ball with a diameter of 0.3 to 2.0 mm at a tip point thereof is charged with an aqueous gel ink having a viscosity ratio (a value of (viscosity at 10 rpm)/(viscosity at 50 rpm) measured by means of an E type rotational viscometer) of 1.1 to 4.0 and an ink lay down value according to JIS Standard S6053 is controlled to 50 to 200 mg/100 m.

2. The aqueous gel ink-filled ball point pen charged with an aqueous gel ink as claimed in claim 1, wherein said aqueous gel ink comprises an aqueous medium comprising a water soluble organic solvent.

3. The aqueous gel ink-filled ball point pen charged with an aqueous gel ink as claimed in claim 2, wherein said water soluble organic solvent comprises a compound selected from the group consisting of alkylene glycols, polyalkylene glycols, triols, glycerols, thiodiethanol, N-methyl-2-pyrrolidone and 1,3-dimethyl-2-imidazolidinone.

4. The aqueous gel ink-filled ball point pen charged with an aqueous gel ink as claimed in claim 3, wherein the water soluble organic solvent comprises propylene glycol.

5. The aqueous gel ink-filled ball point pen charged with an aqueous gel ink as claimed in claim 1, said aqueous gel ink further comprising a pseudo-plasticizer selected from natural resins consisting of xanthan gum, tamarind gum, carrageenan gum, tragacanth gum, locust bean gum, gum arabic, guar gum, curdlan, pectin, agar, gelatin, mannans, and cellulose, and from acrylic synthetic polymers, urethane synthetic polymers, smectite, and montmorillonite.

6. The aqueous gel ink-filled ball point pen charged with an aqueous gel ink as claimed in claim 5, wherein said pseudo-plasticizer is a cellulose selected from the group consisting of methyl cellulose, ethyl cellulose and carboxymethyl cellulose.

7. The aqueous gel ink-filled ball point pen charged with an aqueous gel ink as claimed in claim 6, wherein said cellulose is carboxymethylcellulose.

8. The aqueous gel ink-filled ball point pen charged with an aqueous gel ink as claimed in claim 5, wherein said resins are selected from the group consisting of carboxymethyl cellulose and xanthan gum.

* * * * *